US011136817B2

(12) United States Patent
Tang

(10) Patent No.: US 11,136,817 B2
(45) Date of Patent: Oct. 5, 2021

(54) GRILLE DECORATIVE FLOWER STRUCTURE

(71) Applicant: Jun Tang, Shenzhen (CN)

(72) Inventor: Jun Tang, Shenzhen (CN)

(73) Assignee: Jun Tang, Shenzhen (CN)

( * ) Notice: Subject to any disclaimer, the term of this patent is extended or adjusted under 35 U.S.C. 154(b) by 0 days.

(21) Appl. No.: 16/638,850

(22) PCT Filed: Aug. 1, 2018

(86) PCT No.: PCT/CN2018/098100
§ 371 (c)(1),
(2) Date: Feb. 13, 2020

(87) PCT Pub. No.: WO2019/033925
PCT Pub. Date: Feb. 21, 2019

(65) Prior Publication Data

US 2021/0131173 A1 May 6, 2021

(30) Foreign Application Priority Data

Aug. 13, 2017 (CN) ..... 201710688888.6
Sep. 22, 2017 (CN) ..... 201710865575.3
Feb. 5, 2018 (CN) ..... 201810110320.0

(51) Int. Cl.
*E06B 9/01* (2006.01)
*B44C 5/04* (2006.01)
*B44C 5/06* (2006.01)

(52) U.S. Cl.
CPC ..... *E06B 9/01* (2013.01); *B44C 5/04* (2013.01); *B44C 5/06* (2013.01); *E06B 2009/015* (2013.01)

(58) Field of Classification Search
USPC ..... 52/171.1, 202, 203, 204.61, 656.5
See application file for complete search history.

(56) References Cited

U.S. PATENT DOCUMENTS 3,895,669 A * 7/1975 Heeling ..... E06B 5/003 160/92
4,127,156 A * 11/1978 Brandt ..... E06B 9/01 160/179
4,282,695 A * 8/1981 Lew ..... E04C 2/422 52/664
4,475,309 A * 10/1984 Porter ..... E06B 9/04 49/193
5,437,133 A * 8/1995 Pliml ..... E06B 3/685 49/57
6,085,481 A * 7/2000 Lee ..... E06B 9/01 49/501

(Continued)

*Primary Examiner* — Joshua K Ihezie
(74) *Attorney, Agent, or Firm* — WPAT, PC

(57) ABSTRACT

A safe and convenient grille decorative flower structure comprises a horizontal frame, a mullion, and a flower body. The flower body is disposed in a window pane surrounded by the horizontal frame and the mullion, and the flower body is disposed in the horizontal frame or the mullion. The grille decorative flower structure is convenient to install or assemble, wherein the said structure is detachable and can be disassembled and mailed to clients to install or assemble by themselves. By a simple connection, the bonding strength of the whole framework is higher, and the said structure has an anti-theft effect.

7 Claims, 8 Drawing Sheets

(56) References Cited

U.S. PATENT DOCUMENTS

| | | | | |
|---|---|---|---|---|
| 6,230,456 | B1 * | 5/2001 | Merchlewitz | E06B 3/685 411/347 |
| 8,038,204 | B1 * | 10/2011 | Baker | B60R 19/52 296/193.1 |
| 8,528,279 | B1 * | 9/2013 | Greene, Jr. | E06B 9/01 52/202 |
| 2007/0000195 | A1 * | 1/2007 | Garces | B44C 5/00 52/204.61 |
| 2009/0205283 | A1 * | 8/2009 | Chen | E04C 2/427 52/592.1 |
| 2014/0216834 | A1 * | 8/2014 | Elliott | B60K 11/085 180/68.1 |
| 2016/0236563 | A1 * | 8/2016 | Ruppert | B60R 19/52 |
| 2017/0248066 | A1 * | 8/2017 | Wolf | F01P 7/10 |

* cited by examiner

GRILLE DECORATIVE FLOWER STRUCTURE

BACKGROUND

Technical Field

The present disclosure relates to protective decoration field, and more particularly, to a safe and convenient grille decorative flower structure.

Related Art

At present, guardrails, security window frame bodies and the grille decorative flowers available in the market are all installed by means of an integrated frame or a plurality of pipes welded directly.

Although these installation manners ensure the firmness of the entire frame, these manners need to be operated by professional personnel or require more professional equipment to operate.

If we need to send the entire material to different customers, the customers cannot assemble the material by themselves. That is, the grille in the related art has a problem that the assembly structure is complicated, difficult to install and difficult to mail.

The precedent grille decorative flower structures are fixed by a non-detachable connection such as an integral frame or direct welding to ensure the overall anti-theft effect. If a bolt is exposed, the stability of the entire structure could be destroyed by one bolt, so that the safe and convenient grille decorative flower structure has no anti-theft effect. Therefore, in the installation process, under the premise of ensuring the anti-theft effect, the precedent grille decorative flower structure is an integrated framework. That is, after the connection is made by a non-detachable manner such as welding, the fixing is performed.

SUMMARY

A number of embodiments of the present disclosure are described herein in summary. However, the vocabulary expression of the present disclosure is only used to describe some embodiments (whether or not already in the claims) disclosed in this specification, rather than a complete description of all possible embodiments. Some embodiments described above as various features or aspects of the present disclosure may be combined in different ways to form a grille decorative flower structure or a portion thereof.

The present disclosure is directed to a safe and convenient grille decorative flower structure and features in various aspects to solve at least one of the above problems.

The present disclosure provides a safe and convenient grille decorative flower structure, comprising a horizontal frame, a grille of a mullion and a flower body, wherein the flower body is disposed in the horizontal frame and the grille surrounded by the mullion; wherein the flower body is fixed on the horizontal frame or the mullion. In some embodiments, the flower body and the outer frames are separately manufactured which is suitable for industrial production. If a detachable bolt is utilized in connection, the flower body achieves functions such as disassembly and cleaning.

In some embodiments, the flower body comprises the outer frames that are interlocked, and then then connected to the horizontal frame or the mullion. The interlock is connected by two pieces, not the addition of knots. The advantage of the embodiment of the present disclosure is that the entire flower body is fixed by the bolts in the lateral direction, and the bolts are connected with the horizontal frame and the subsequent cover plate on the mullion, and the bolts are not exposed. The grille decorative flower structure is safe and detachable.

In some embodiments, the outer frames comprise a first fixed portion and a second fixed portion, wherein the first fixed portion and the second fixed portion are interlocked. The outer frames have through holes disposed thereof for bolts to pass through. The fixing manner is further explained in the previous paragraph, that is, after the connection is performed, the two outer frames in the flower body are fixed on the horizontal frame or the mullion by the bolts. This design greatly enhances the safety of the present disclosure.

In some embodiments, the flower body comprises stamens fixed by the outer frames, wherein and the outer frames and the stamens are detachably fixed. One of the fixing manners is that the position that the stamens embedded in grooves of the outer frames has protruded edges disposed on the periphery thereof; wherein the stamens are interlocked and fixed by cavities defined by the interlocked outer frames. The other of the fixing manners is that position that the stamens embedded in grooves of the outer frames has protruded edges disposed on the periphery thereof; wherein the stamens are interlocked and fixed by cavities defined by the protruded edges; wherein there could also be other fixing manners, such as snap-fitting, fastener-fixing, etc.

In some embodiments, the stamens refer to a portion defined by the outer frames. If the protruded edges are absent, the stamens can be directly embedded in the outer frames and can be pushed in from one side and pushed out from the other side. There is no limit.

In some embodiments, the limitation of the stamens is to extend the length of the bolts that secures the outer frames as a whole so that the bolts also define the stamens. In the present disclosure, the position of the stamen has the protruded edges to facilitate the snap-fitting assembly of the outer frames, wherein the entire periphery of the stamens is defined by the protruded edges, which is simple and efficient; meanwhile, it is conceivable that in order to enhance the fixing strength of the entire flower body, if necessary, the above-mentioned manner of extending the length of the bolts can also be utilized at the same time.

In some embodiments, the grille decorative flower structure comprises a first flower body, wherein the first flower body is disposed on the mullion; wherein the flower body has a plurality of positioning and fixing grooves disposed thereof; wherein the grooves coordinates with the mullion; wherein the flower body has a plurality of the grooves disposed and spaced in various ranges on the grille structure thereof for facilitating the installation of the grille structure.

In some embodiments, the grille decorative flower structure comprises a second flower body, wherein the horizontal frame and the mullion have limiting grooves disposed thereof; wherein the limiting grooves are all oriented toward the second flower body; wherein the second flower body is sliding into the limiting grooves in the installation process and are positioned and fixed by the limiting grooves on the four sides of the horizontal frame and the mullion.

In some embodiments, the horizontal frame comprises a main body, ribs and plates, wherein the main body of the horizontal frame is connected sequentially and forms a first plate, a second plate, a third plate, and a fourth plate; wherein the ribs comprise a first rib and a second rib; wherein the first rib is connected to the first plate, and the second rib is connected to the third plate; wherein the first rib is regarded as an extension of the first plate, and the second rib is regarded as an extension of the third plate; when connected, the mullion is abutted to the fourth plate, wherein the plates define the front position and the rear position of the mullion; wherein both ends of the mullion are respectively defined by the horizontal frame; wherein the first rib, the fourth plate, and the second rib are connected sequentially and form the limiting grooves, and the mullion coordinates with the limiting grooves.

In some embodiments, the horizontal frame has through holes disposed and spaced in a certain range thereof for bolts to pass through; wherein the fourth plate has the through holes disposed thereof; wherein the horizontal frame comprises a cover plate; wherein the cover plate is engaged to the horizontal frame by a snap-fit structure, covering the through holes.

In some embodiments, the horizontal frame has through holes disposed and spaced in a certain range thereof for bolts to pass through; wherein the horizontal frame comprises cards; wherein the cards are inserted into the interior of the horizontal frame, covering the through holes, which prevents the bolt from being exposed and enhances safety.

In some embodiments, the length of the cards is greater than the length from any of the through holes to an end of the horizontal frame, so that even if the cards are sliding in the lateral direction, the action does not expose the through holes, unless the entire body is detached, the cards are sliding from one side, which facilitates installation and enhances safety.

In order to further achieve one or more of the advantages of an easy disassembly of the flower body, anti-theft effect, aesthetics, easy cleaning, simple and convenient for mailing. The present disclosure provides a flower body, wherein the flower body comprises the outer frames that are interlocked.

In some embodiments, the flower body comprises the stamens engaged to the outer frames.

In some embodiments, the stamens are interlocked to be clamped in the outer frames.

In some embodiments, the outer frames comprise the first fixed portion and the second fixed portion, wherein the first fixed portion and the second fixed portion are interlocked.

In some embodiments, the flower body comprises the stamens, wherein the flower body comprises a hollow portion for accommodating the stamens; wherein the stamens are placed in the hollow portion and fixed on the outer frames.

In some embodiments, the stamens have a plurality of protrusions or grooves disposed on the side thereof, wherein the position that the stamens embedded in the outer frames has a plurality of corresponding protrusions or grooves disposed thereof; wherein the stamens and the outer frames are mutually embedded by the protrusions and/or the grooves; wherein the first fixed portion and the second fixed portion are interlocked.

In some embodiments, the position that the stamens embedded in the outer frames has the protruded edges disposed on the side thereof, wherein the stamens are fixed by the interlocked outer frames and the cavities defined by the protruded edges.

The present disclosure has a prominent and beneficial technical effect, wherein the safe and convenient grille decorative flower structure is convenient to install or assemble; wherein the said structure is detachable and can be disassembled and mailed to customers to install or assemble by themselves. By the simple connection, the bonding strength of the whole framework is higher, and the said structure is equipped with anti-theft effect, especially suitable for guardrails, security doors and windows and other grille decorative flower products.

DETAILED DESCRIPTION

Figure 1:
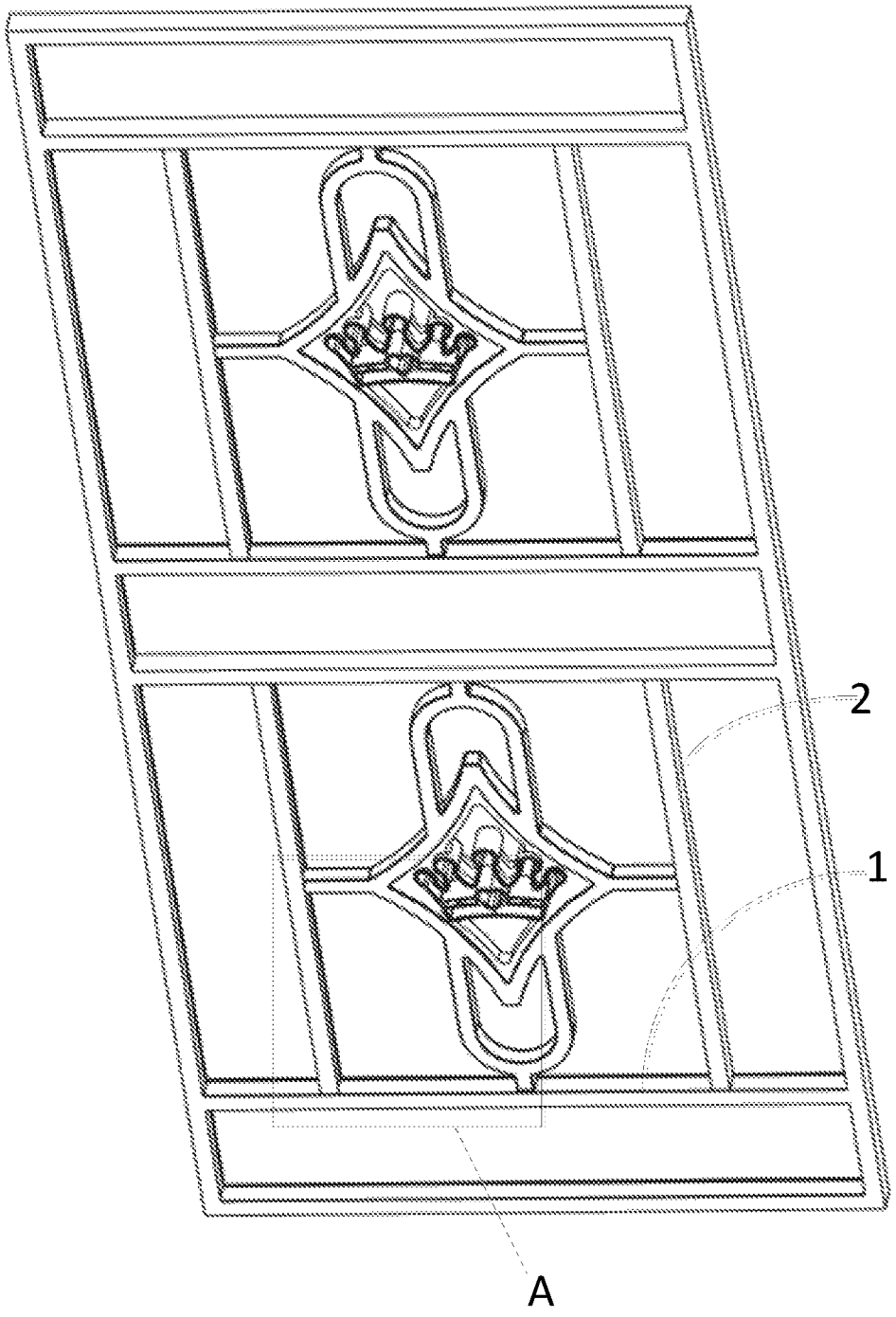
FIG. 1 illustrates a three-dimensional diagram of the first embodiment of the instant disclosure.
Figure 2:
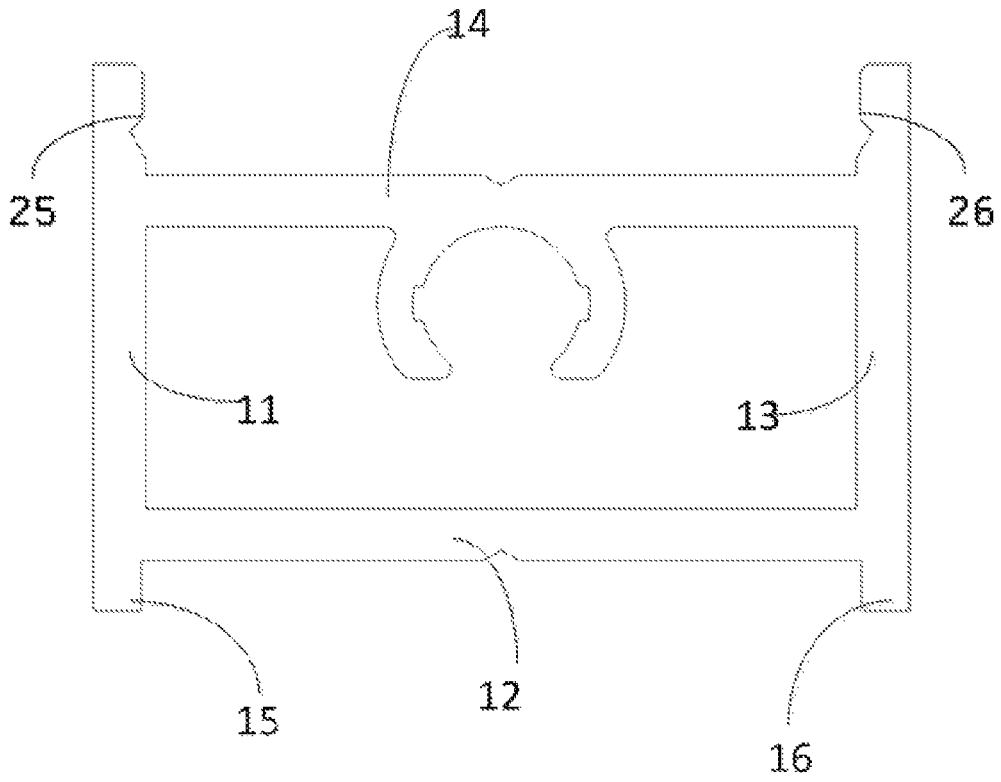
FIG. 2 illustrates a cross-section diagram (1) of the horizontal frame of the instant disclosure.
Figure 3:
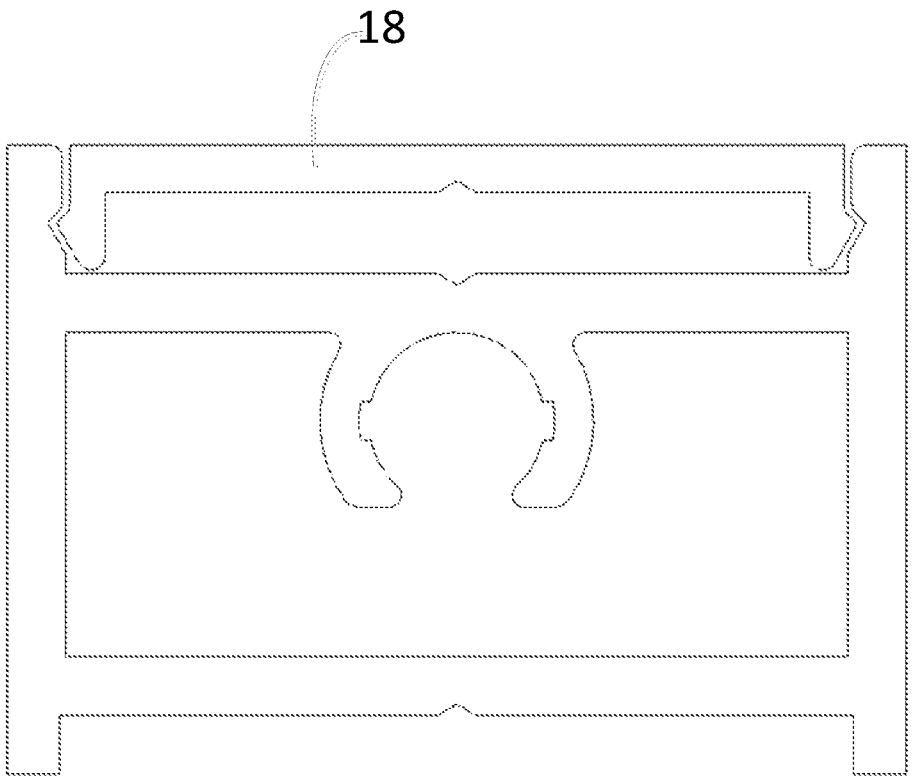
FIG. 3 illustrates a cross-section diagram (2) of the horizontal frame of the instant disclosure.
Figure 4:
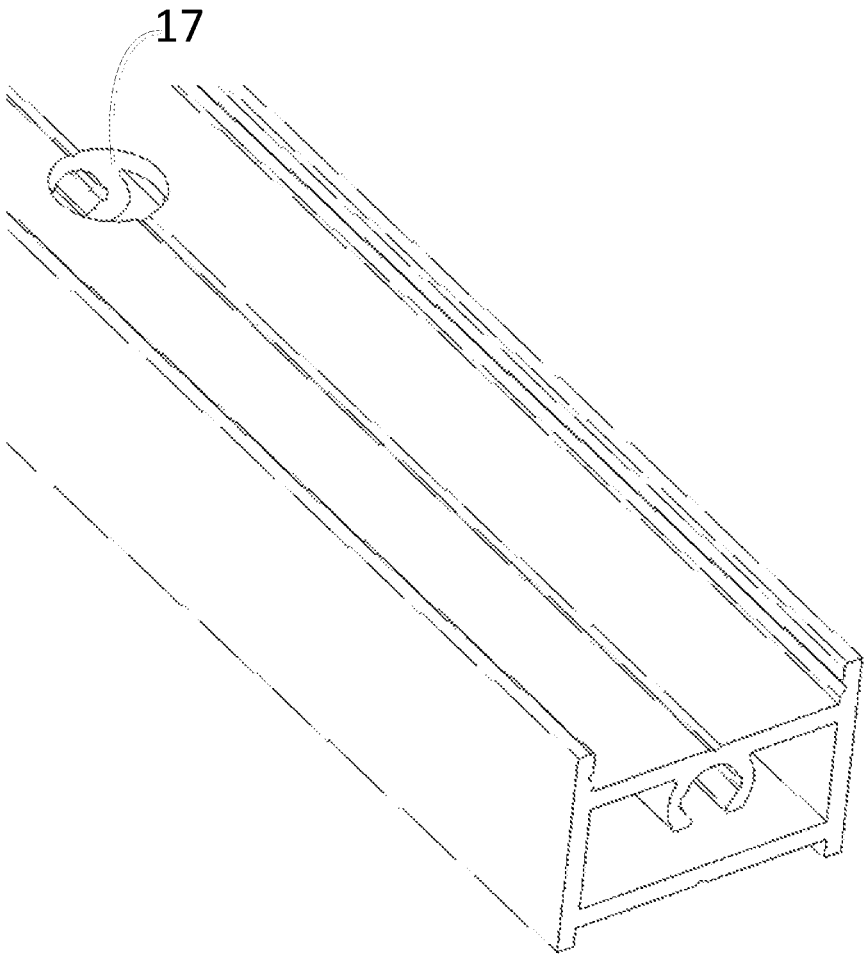
FIG. 4 illustrates a three-dimensional diagram of an end of the horizontal frame of the instant disclosure.

Embodiments of the present disclosure are described in detail below, examples of which are illustrated in the accompanying drawings. The embodiments described below with reference to the drawings are intended to be illustrative of the present disclosure and are not to be understood as limitations of the present disclosure.

In the description of the present disclosure, it is to be understood that the terms "center", "longitudinal", "lateral", "length", "width", "thickness", "upper", "lower", "front", "after", "left", "right", "vertical", "horizontal", "top", "bottom", "inside", "outside", "clockwise", "counterclockwise", "axial", "radial", "circumferential" and the like, the orientation or positional relationship, is based on the orientation or positional relationship shown in the drawings, and is merely for the convenience of describing the present disclosure and the simplified description, and does not indicate or imply the indicated device or component must be constructed and operated in a particular orientation, and is not to be considered as limitations of the present disclosure.

Moreover, the terms "first" and "second" are used for descriptive purposes only and are not to be construed as indicating or implying a relative importance or implicitly indicating the number of technical features indicated. Thus, features defining "first" and "second" may include at least one of the features, either explicitly or implicitly. In the description of the present disclosure, the meaning of "a plurality" is at least two, such as two, three, etc., unless specifically defined otherwise.

In the present disclosure, the terms "installation", "coupled", "connected", "fixed" and the like shall be understood broadly, unless explicitly stated and defined otherwise, and may be either a fixed connection or a detachable connection; it may also be in one piece, a mechanical connection, an electrical connection or a communication with each other; it may be directly connected or indirectly connected through an intermediate medium, and may be an internal connection of two elements or an interaction relationship between two elements, unless otherwise expressly defined. For those skilled in the art, the specific meanings of the above terms in the present disclosure can be understood on a case-by-case basis.

In the present disclosure, the first feature "on" or "under" the second feature may be a direct contact of the first and second features, or the first and second features may be indirectly contact through an intermediate medium, unless otherwise explicitly stated and defined. Moreover, the first feature "above", "on" and "upside" the second feature may be that the first feature is directly above or above the second feature, or merely that the first feature level is higher than the second feature. The first feature "below", "under" and "beneath" the second feature may be that the first feature is directly below or obliquely below the second feature, or merely that the first feature level is less than the second feature.

Please refer to FIG. 1 to FIG. 4, the instant disclosure provides an embodiment, wherein a safe and convenient grille decorative flower structure comprises a horizontal frame 1 and a mullion 2; wherein ribs and cover plates are disposed on the horizontal frame 1 or the mullion. The following is an example of the horizontal frame.

The horizontal frame 1 comprises a body, wherein ribs and plates are disposed on the body of the horizontal frame 1; wherein a first plate 11, a second plate 12, a third plate 13, and a fourth plate 14 which are sequentially connected and form the body of the horizontal frame; wherein the ribs comprise a first rib 15 and a second rib 16; wherein the plates further comprise a first guard 25 and a second guard 26. The first plate 11 has the first rib 15 and the first guard 25 disposed respectively at both ends thereof, wherein the third plate 13 has the second rib 16 and the second guard 26 disposed respectively at both ends thereof. The first rib 15 and the first guard 25 can be regarded as an extension of the first plate 11, and the second rib 16 and the second guard 26 can be regarded as an extension of the third plate 13.

When connecting the horizontal frame 1 and the mullion 2, the mullion 2 is abutted to the fourth plate 14; wherein the first guard 25 and the second guard 26 defined the front position and the rear position of the mullion 2, by bolts or other fixing manners to defined other detachable fixing manners; wherein both ends of the mullion 2 are respectively defined by the horizontal frame 1; wherein the first guard 25, the fourth plate 14, and the second guard 26 are connected sequentially and form limiting grooves 19, 29, and the mullion 2 coordinates with the limiting grooves 19, 29.

Furthermore, the mullion 2 has an O-shaped groove structure disposed in the interior thereof (not shown) for facilitating the bolts to pass through. By the fixing manner, the bolts easily pass through the horizontal frame 1 and fix the mullion. Please refer to FIG. 3 and FIG. 4, the horizontal frame 1 has through holes 17 disposed thereof for bolts to pass through; wherein the fourth plate 14 has the through holes 17 disposed thereof; wherein the second plate 12 has the through holes 17 disposed thereof according to the following circumstance: when the horizontal frame 1 comprises cover plates 18, through holes 17 not disposed on the second plate 2 thereof; wherein the cover plates 18 are engaged to the horizontal frame 1 by a snap-fit structure, covering the through holes 17. In some embodiments, the horizontal frame 1 can also be the structure, wherein the horizontal frame 1 comprises cards; wherein the cards are inserted into the interior of the horizontal frame 1, covering the through holes 17. In order to ensure safety, the length of the cards is substantially the same as the length of the horizontal frame 1.

The structural designs of the horizontal frame 1 and the mullion 2 above can be mutually replaced and alternated. That is, the mullion 2 has the limiting grooves 19, 29 disposed thereof, and the horizontal frame 1 coordinates with the limiting grooves 19, 29 to perform the installation.

Figure 5:
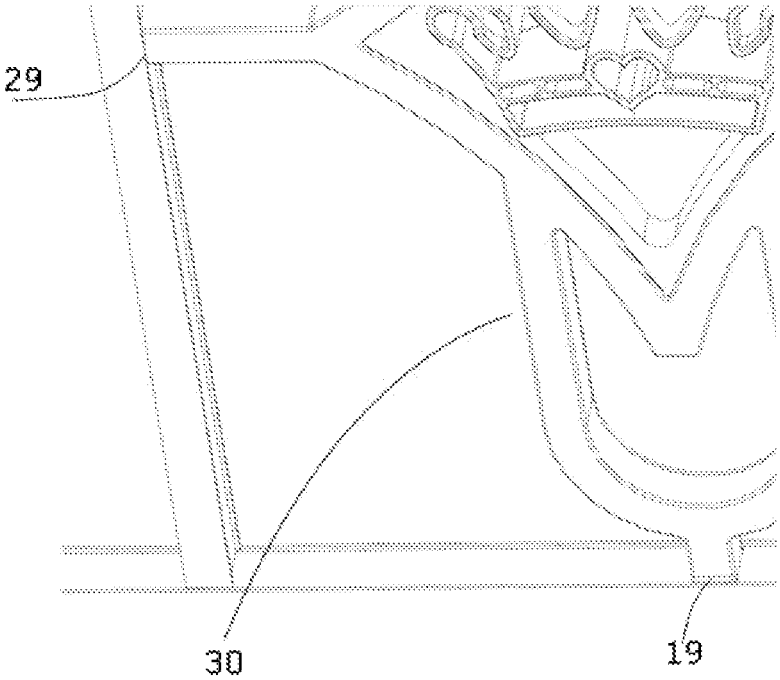
FIG. 5 illustrates a zoom-in diagram showing an area A in FIG. 1.
Figure 6:
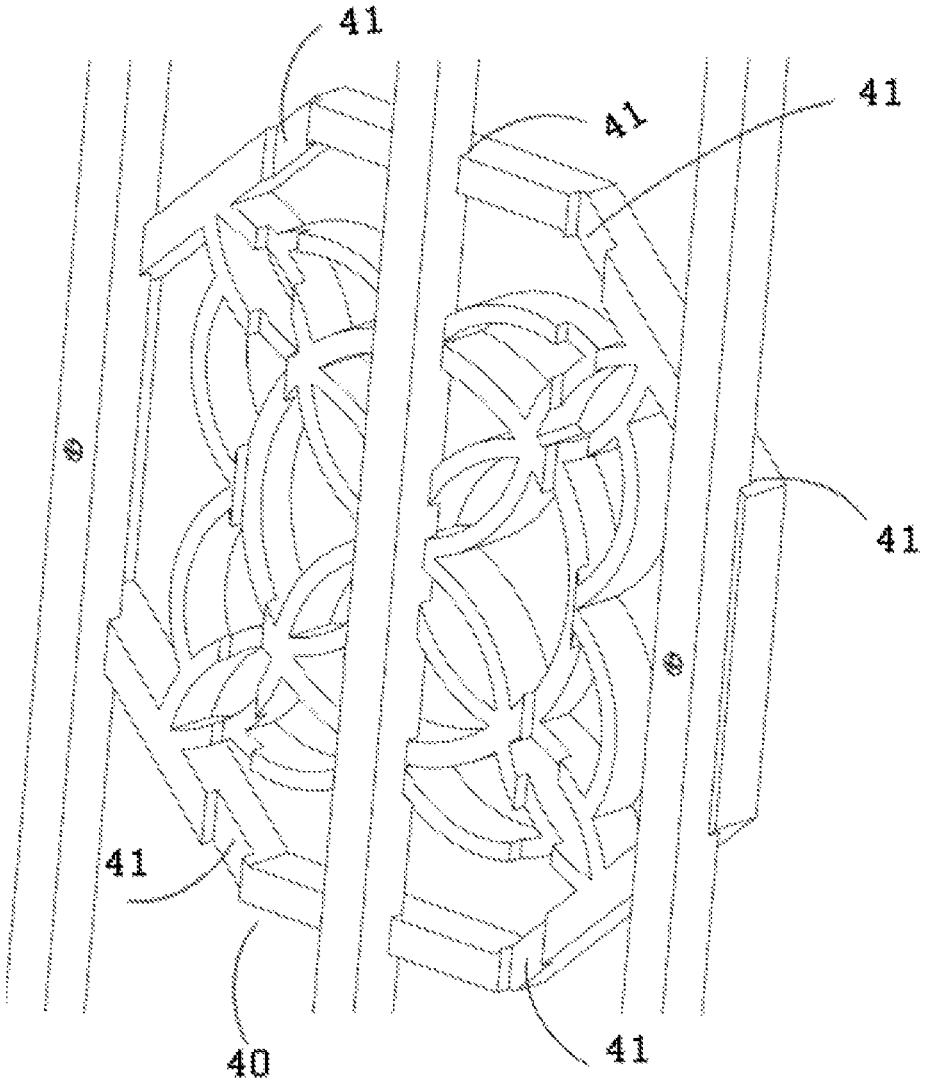
FIG. 6 illustrates a partial three-dimensional diagram of the second embodiment of the instant disclosure.
Figure 7:
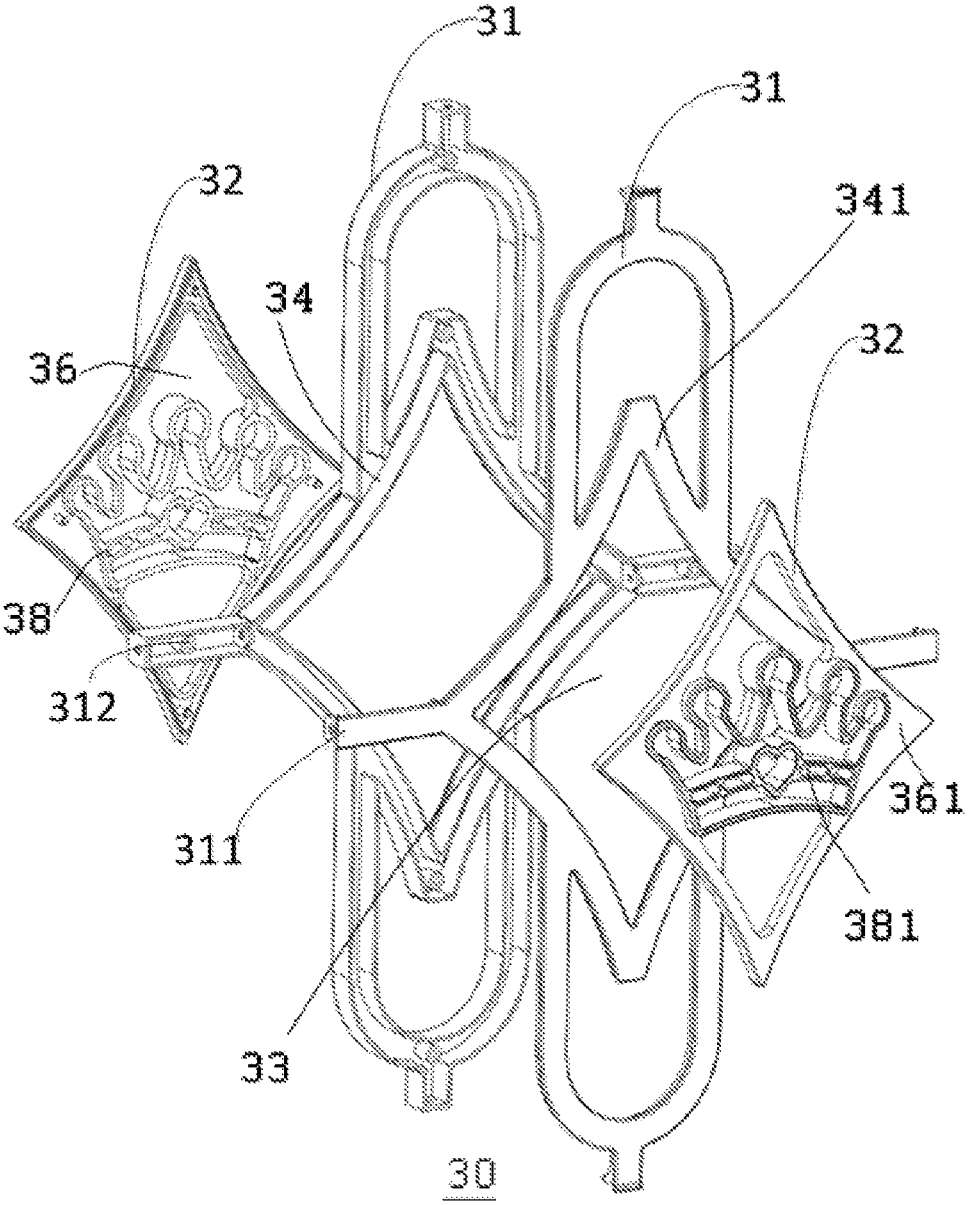
FIG. 7 illustrates an exploded diagram of the structure of the second flower body.

Please refer to FIG. 5 to FIG. 8, as shown in FIG. 7, the flower body comprises outer frames 31 that are interlocked, wherein the outer frames 31 comprise a first fixed portion 311 and a second fixed portion 312; wherein the first fixed portion 311 and the second fixed portion 312 are interlocked.

The flower body further comprises stamens 32, wherein the flower body comprises a hollow portion 33 for accommodating the stamens 32; wherein the stamens 32 are placed in the hollow portion 33 and fixed on the outer frames 31. It is understood that the manner in which the stamens 32 are fixed on the hollow portion 33 is varied. Manner 1: the stamens 32 are embedded in the hollow portion 33, wherein the stamens 32 are engaged to the outer frames 31 by the bolts. Manner 2: the stamens 32 are embedded in the hollow portion 33, wherein the stamens 32 are engaged sequentially with the horizontal frame 1 and the outer frames 31 by the bolts. Manner 3: the stamens 32 are embedded in the hollow portion 33, wherein the stamens 32 are engaged sequentially with the mullion 2 and the outer frames 31. Manner 4: the hollow portion 33 has extra ribs disposed on the side thereof, wherein the outer frames 31 are connected by two pieces, the stamens 32 are fixed in the hollow portion 33 by the ribs to form a structure of a sandwich biscuit. Manner 5: the stamens 32 have blocks disposed on the periphery thereof and embedded in the grooves of the outer frames 31; wherein the stamens 32 are fixed by cavities defined by the interlocked outer frames 31 (not shown).

Please refer to FIG. 5 and FIG. 6, in order to connect and fix the horizontal frame 1 and the mullion 2, the flower body comprises at least two designs of the following: the first flower body 40 and the second flower body 30. The flower body may be fixed on the horizontal frame 1 or the mullion 2 by the bolts, or may be fixed by welding or the like. If the bolts are utilized for fixing, the integrity of the entire window structure is ensured. If the flower body is fixed by welding, it can be ensured there is no slit in the connection between the flower body and the horizontal frame 1 or the mullion 2, thereby enhancing the anti-theft effect.

Please refer to FIG. 6, the present disclosure provides an embodiment, wherein the grille decorative flower structure comprises the first flower body 40 disposed on the horizontal frame 1 and/or the mullion 2. The first flower body 40 has a plurality of positioning and fixing grooves 41 disposed and spaced in a range thereof for facilitating installation of the grille structure. The grooves 41 coordinates with the horizontal frame 1 or the mullion 2, wherein the first flower body 40 can be separately manufactured and finished; wherein the horizontal frame 1 or the mullion 2 performs the opening of the grooves according to the size of the horizontal frame 1 or the mullion 2.

It is understood that the installation of the first flower body 40 can be directly fixed on the grille decorative flower structure by bolts or welding, wherein bolt fixing is more convenient to operate.

Please refer to FIG. 5, the present disclosure provides an embodiment, wherein the grille decorative flower structure comprises the second flower body 30 disposed on the horizontal frame 1 and/or the mullion 2. When the second flower body 30 is disposed, the horizontal frame 1 and the mullion 2 have limiting grooves 19, 29 disposed respectively thereof, wherein the limiting grooves 19, 29 are all oriented toward the second flower body 30. In installation, the second flower body 30 can be sliding into the grille decorative flower structure that has been positioned on three sides, and then positioned on the fourth side to be fixed. The structure greatly facilitates the installation of the grille decorative flower structure for non-professionals by its simple, convenient and reliable features.

The instant disclosure provides an embodiment, wherein the second flower body 30 further comprises a main body 34, a cover plate 36 and an interior pattern 38; wherein the interior pattern 38 is embedded in the main body 34 of the second flower body 30; wherein the cover plate 36 of the second flower body 30 connects with the main body 34 of the second flower body 30 and defines the position of the interior pattern 38.

It is conceivable that the "connection" referred to in the present disclosure includes not only the interlock, but also the mutual hook engagement, the interference fit, the coordination of the protrusions and the grooves, and the like.

Please refer to FIG. 7, the main body 34 of the second flower body 30 corresponds to a main body 341 of a cross frame, wherein the cover plate 36 of the second flower body 30 corresponds to a cover plate 361 of the cross frame; wherein an interior rhombus structure 381 or an interior rhombus crown structure 381 corresponds to the interior pattern 38.

Please refer to FIG. 7, the second flower main body 41 corresponds to the main body 341 of the cross frame, wherein the cover plate 36 of the second flower body 30 corresponds to the cover plate 361 of the cross frame; wherein the interior rhombus structure 381 or an interior rhombus crown structure 381 corresponds to the interior pattern 38.

It is conceivable that the cover plate 361 of the cross frame may be disposed on both sides of the main body 341 of the cross frame to position the interior rhombus structure 381.

Furthermore, the second flower body comprises two interlocked outer frames 31 and two snap-fitted stamen 32, wherein the outer frames 31 are interlocked to define the stamens 32 in a preset position. As shown in FIG. 7, after the two rhombus stamens 32 are engaged, the stamens 32 are defined at the center of the outer frames 31 by the outer frames 31. That is, the interlocked outer frames 31 have protruded edges disposed at the center thereof, wherein the four sides of stamens 32 are defined by the protruded edges. In some embodiments, the stamens 32 can also be integrated, and the split-type design in the drawing is more convenient to manufacture. However, it is not limited to such a split-type of stamens 32.

In the present disclosure, the flower body and the stamens 32 are modularly designed, so that the stamens 32 are detachably replaced, so that the customers can select or customize the shape or pattern that they like. Meanwhile, the structure is improved so that the structure retains the anti-theft effect of the structure to the utmost extent while satisfying the replaceability. In order to achieve the integration of the above effects, the present disclosure is implemented by the following technical solutions.

The position that the stamen 32 embedded in the outer frames 31 has protruded edges disposed thereof; wherein the stamens 32 are fixed by the interlocked outer frames 31 and cavities defined by the protruded edges.

A stamen 32 comprises two parts which are interlocked to form the stamen 32.

Please refer to FIG. 7, the outer frames 31 further comprise fixed portions that coordinate with each other, that is, the first fixed portion 311 and the second fixed portion 312. The first fixed portion 311 and the second fixed portion 312 are interlocked, and have through holes disposed thereof for bolts to pass through. Fixed plates embedded in the second fixed portion 312 are disposed on the first fixed portion 311, and the fixed plates are embedded in the second fixed portion 312. The second flower body 30 is fixed on the entire frame by bolts passing through the through holes 17 of the first fixed portion 311 and the second fixed portion 312. Also, connecting plates are disposed at the ends of the first fixed portion 311 and the second fixed portion 312, wherein the connecting plates are respectively disposed at the ends of the first fixed portion 311 and the second fixed portion 312, and the connecting plates have through holes disposed thereof. After the first fixed portion 311 and the second fixed portion 312 are connected, only one hole is seen from the side of the entire grille decorative flower structure, and a bolt from the horizontal frame 1 or the mullion 2 passes through the through hole to secure the outer frames 31 in the entire frame.

It is conceivable that after the two outer frames 31 are interlocked, the outer frames 31 can also be fixed on the horizontal frame 1 and/or the mullion 2 by welding.

From the above description, the embodiment of the present disclosure in which the flower body is engaged to the horizontal frame 1 or the mullion 2 tends to be bolted or welded, and is of course not limited to other fixing manners.

In the present disclosure, the arrangement of the flower body is considered in various aspects, and solves a plurality of problems, including but not limited to anti-theft, aesthetics, easy cleaning, simple, convenient disassembly, convenient mailing and the like. In order to achieve one or more of the above advantages, there are many designs of the present disclosure in the flower body, and several designs are briefly described below:

1. Split-fit type as described above;

2. Another connecting method: that is, the stamen 32 is a split-type connection, and the outer frames 31 are sandwiched and then fixed by welding or bolting. In order to ensure the anti-theft effect, it is also considered that the bolts are not exposed on the exterior of the horizontal frame 1 or the mullion 2, so the bolts here should be fixed, and the bolts for fixing the outer frames 31 to the horizontal frame 1 or the mullion 2 are inserted into the frame of the stamens 32 to be fixed; or the top can be fixed to the outside of the stamens 32, and the stamens 32 can also be fixed due to a plurality of top positions. Because there are no bolts exposed on the surface of the exterior of the horizontal frame 1 or the mullion 2, there will be no major safety hazards, and the anti-theft effect is guaranteed.

3. The form of the second flower body 30 as above is mainly used to solve the problem of convenient disassembly and installation, and is fixed by bolts or welding directly.

4. The outer frames 31 and the stamens 32 are connected by a mortising manner, and the connection manner is various. For example, the stamens 32 have a plurality of protrusions or grooves disposed on the side thereof, and the outer frames 31 are embedded with a plurality of corresponding grooves or protrusions at the position of the stamens 32, and the stamens 32 and the outer frames 31 are coordinately interlocked. The fixing is performed by the manner no bolts exposed on the exterior of the horizontal frame 1 or the mullion 2; or the fixing is performed by mortising and then welding.

Figure 8:
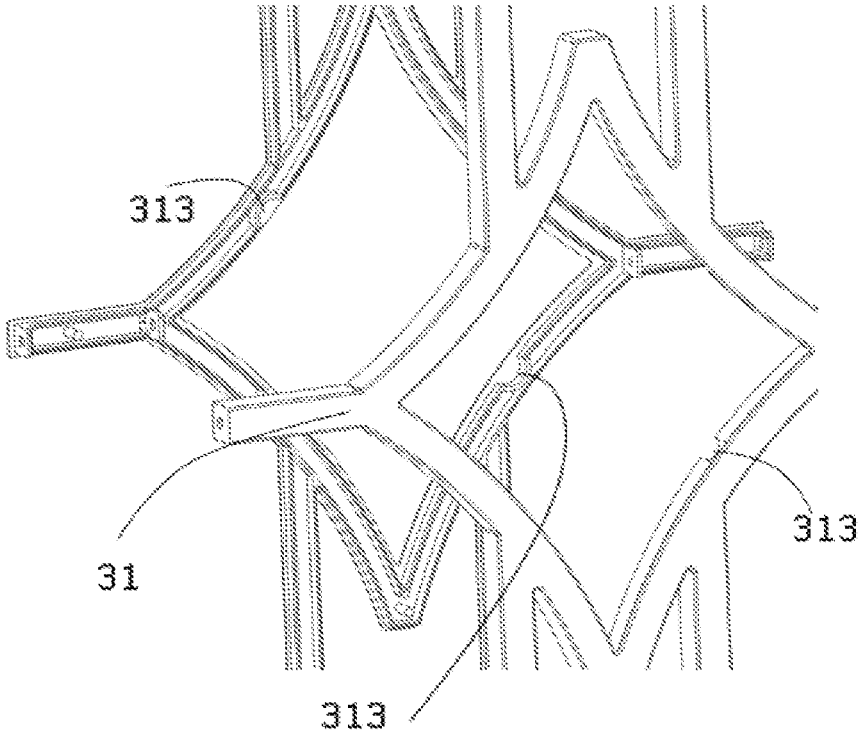
FIG. 8 illustrates a schematic diagram showing another design of the outer frames.

Please refer to FIG. 8, the outer frames 31 have grooves 313 disposed thereof, that is, the position that the stamens 32 embedded in the outer frames 31 has the grooves 313 disposed thereof. By the grooves 313 engaged with the protrusions of the stamens 32, positioning and fixing are better performed. Combined with FIG. 8, it is conceivable that the stamens 32 have the protrusions disposed thereof. Also, it is conceivable that the arrangement of the protrusions and the grooves 313 can be mutually replaced and alternated as mentioned above in the present disclosure.

In addition, it is conceivable that the stamens 32 can also be connected by two pieces like the outer frames 31, and then engaged to the outer frame 31 by welding, bolting, interference fit or the like. Meanwhile, the arrangement of a plurality of protrusions as described above can also be applied to the design.

The above is only the preferred embodiment of the present disclosure, and is not intended to limit the present disclosure. Any modifications, equivalent substitutions and improvements made within the spirit and principles of the present disclosure should be included in the protection of the present disclosure within the scope.

What is claimed is:

1. A grille decorative flower structure, comprising:

a horizontal frame;

a mullion; and a flower body, disposed in a window pane surrounded by the horizontal frame and the mullion;

wherein the flower body is fixed on the horizontal frame or the mullion;

wherein the flower body comprises two piece of outer frames that are interlocked correspondingly;

wherein the two piece of outer frames are interlocked and then engaged to the horizontal frame or the mullion;

wherein the two piece of outer frames comprise a first fixed portion and a second fixed portion, respectively;

wherein the first fixed portion and the second fixed portion are interlocked; and wherein the flower body further comprises two pieces of stamens correspondingly interlocked and then fixed by the outer frames; wherein the outer frames and the stamens are detachably fixed.

2. The grille decorative flower structure of claim 1, wherein the flower body comprises a first flower body; wherein the first flower body is disposed on the mullion; wherein the first flower body has a plurality of positioning and fixing grooves disposed thereof; wherein the positioning and fixing grooves coordinates with the mullion.

3. The grille decorative flower structure of claim 1, wherein the flower body comprises a second flower body; wherein the horizontal frame and the mullion have limiting grooves disposed thereof; wherein the limiting grooves are all oriented toward the second flower body; wherein the second flower body is sliding into the limiting grooves in installation; wherein the second flower body is positioned and fixed by the limiting grooves on the four sides of the horizontal frame and the mullion.

4. The grille decorative flower structure of claim 1, wherein the horizontal frame comprises a main body and ribs; wherein the main body of the horizontal frame is connected sequentially and forms a first plate, a second plate, a third plate, and a fourth plate; wherein the ribs comprise a first rib and a second rib; wherein the first rib is connected to the first plate, and the second rib is connected to the third plate; wherein the first rib is regarded as an extension of the first plate, and the second rib is regarded as an extension of the third plate; when connected, the mullion is abutted to the fourth plate;

wherein the plates define a front position and a rear position of the mullion; wherein both ends of the mullion are respectively defined by the horizontal frame; wherein the first rib, the fourth plate, and the second rib are connected sequentially and form the limiting grooves, and the mullion coordinates with the limiting grooves.

5. The grille decorative flower structure of claim 4, wherein the horizontal frame has through holes disposed and spaced in a range thereof for bolts to pass through;

wherein the fourth plate has the through holes disposed thereof; wherein the horizontal frame comprises cover plates; wherein the cover plates are connected to the horizontal frame by a snap-fit structure, covering the through holes.

6. The flower body of claim 1, wherein the two piece of stamens are interlocked to be clamped in the outer frames.

7. The flower body of claim 1, wherein the outer frames further comprises a hollow portion for accommodating the stamens; wherein the stamens are placed in the hollow portion and fixed on the outer frames.

* * * * *